United States Patent [19]

Walitalo

[11] 4,106,734

[45] Aug. 15, 1978

[54] BAG DISPENSER AND HOLDER

[75] Inventor: Charles Richard Walitalo, Matteson, Ill.

[73] Assignee: Union Carbide Corporation, New York, N.Y.

[21] Appl. No.: 782,387

[22] Filed: Mar. 29, 1977

[51] Int. Cl.[2] ..... B65B 67/04

[52] U.S. Cl. ..... 248/100; 53/189; 53/390; 211/59.1; 221/312 A; 248/222.2

[58] Field of Search ..... 248/99, 95, 100, 222.2, 248/222.3, 223.3, 225.1, 225.2, 311.1, 312; 211/57.1, 59.1, 54.1; 53/384, 390, 189; 221/310, 312 A; 15/257.1; 206/526, 801

[56] References Cited

U.S. PATENT DOCUMENTS

| | | | |
|---|---|---|---|
| 289,181 | 11/1883 | Valentine | 248/99 |
| 739,655 | 9/1903 | Detwiler | 211/57.1 X |
| 810,379 | 1/1906 | Dyett | 248/99 |
| 939,508 | 11/1909 | Hull | 248/100 |
| 991,245 | 5/1911 | Rhoades | 211/54.1 |
| 1,351,094 | 8/1920 | Buckel | 248/100 |
| 1,590,172 | 6/1926 | Thorberg | 211/59.1 X |
| 1,653,393 | 12/1927 | Cox | 248/99 |
| 1,760,752 | 5/1930 | Happer | 248/99 |
| 1,809,317 | 6/1931 | Snyder | 248/101 X |
| 1,895,904 | 1/1933 | Lutts et al. | 248/99 |
| 2,903,215 | 9/1959 | Metcalf | 248/99 |
| 2,927,715 | 3/1960 | Lux | 221/108 |
| 3,008,569 | 11/1961 | Murch | 206/19.5 |
| 3,380,579 | 4/1968 | Pinto | 206/526 X |
| 3,454,166 | 7/1969 | Dinges | 206/526 X |
| 3,653,619 | 4/1972 | Plum | 248/99 |
| 3,738,482 | 6/1973 | Cwikla | 248/100 X |
| 3,770,134 | 11/1973 | Kupcikevicius | 211/57 |
| 3,777,930 | 12/1973 | Ericson et al. | 221/26 |
| 3,861,125 | 1/1975 | Hagemeister | 53/390 |
| 4,023,842 | 5/1977 | Harvey | 248/99 X |

FOREIGN PATENT DOCUMENTS

| | | | |
|---|---|---|---|
| 102,502 | 8/1965 | Denmark | 248/100 |
| 2,002,732 | 8/1970 | Fed. Rep. of Germany | 248/100 |
| 878,426 | 9/1961 | United Kingdom | 248/311.1 |
| 1,262,956 | 2/1972 | United Kingdom | 248/99 |

*Primary Examiner*—Rodney H. Bonck
*Attorney, Agent, or Firm*—Cornelius F. O'Brien

[57] ABSTRACT

A bag dispenser and holder comprising a pair of spaced-apart wicket and support members from which outwardly and oppositely opposed deformable arcuate members distend to define a substantial hoop configuration for supporting and maintaining a bag having wicket holes in an open position.

15 Claims, 31 Drawing Figures

FIG. 1
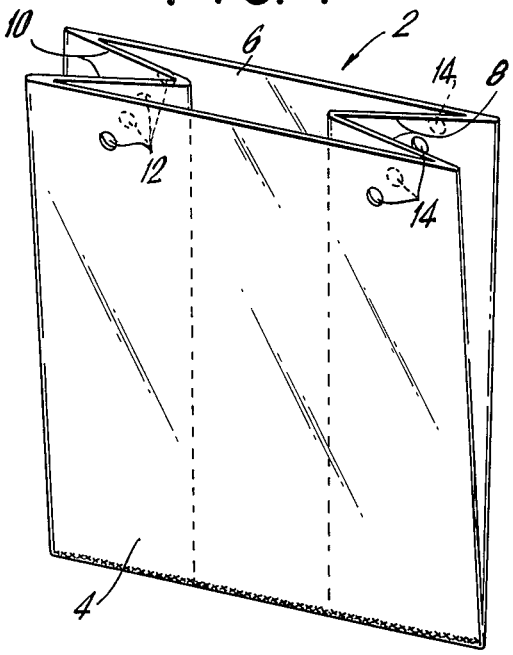
FIG. 2
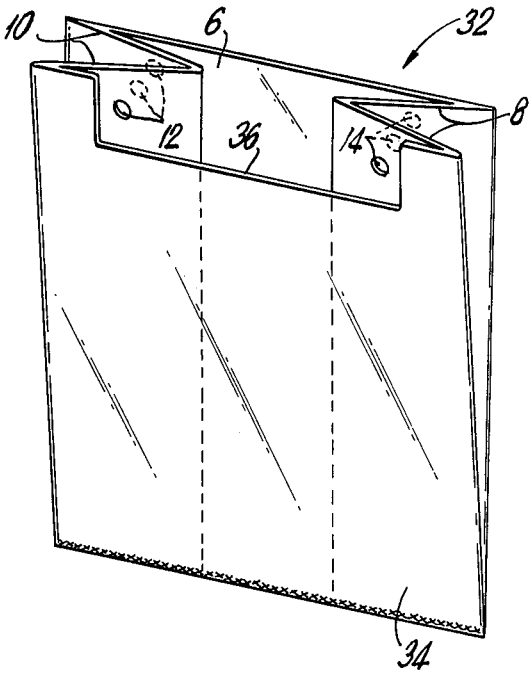
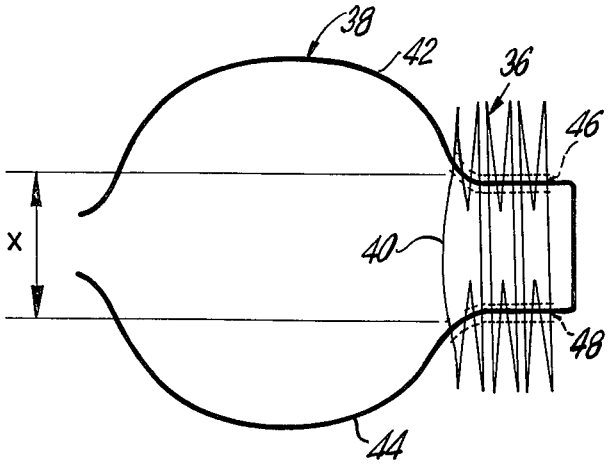
FIG. 5
FIG. 6
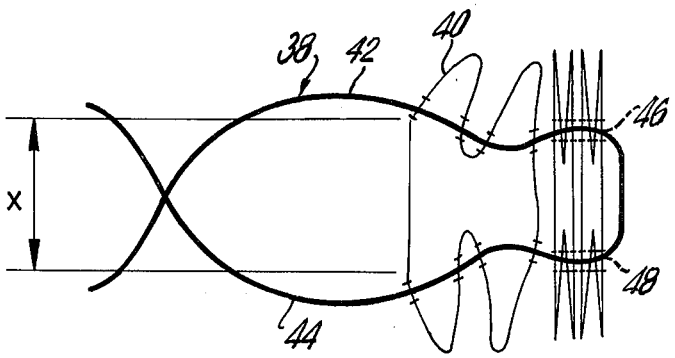

BAG DISPENSER AND HOLDER

FIELD OF THE INVENTION

The invention relates to a bag dispenser and holder for supporting a plurality of stacked bags which are to be dispensed or removed from the stack one at a time and having a brace member with distending arcuate members for supporting the dispensed bag in an open position for utilization.

BACKGROUND OF THE INVENTION

Packaging operations in industry are of significant import with interest towards promoting the rapid, efficient and economical packaging of products for the market. In commercial applications, such as the packaging of groceries or household articles or trash, it is highly desirable to have means whereby a bag can be easily dispensed from a carton and held in an open position for receiving various types of contents. Although many bag dispensers are available from which bags can be dispensed one at a time, the bags, either made of paper base material or flexible plastic film material, are usually strong enough to contain various size and weight articles, but are not strong enough or have sufficient integrity to retain an upright open position during the packaging operation without some additional support or retaining means.

U.S. Pat. Nos. 810,329, 939,508, 1,653,393, 1,760,752, 1,895,904, 2,903,215 and 3,653,619 all disclose various support or retaining means for maintaining a bag in an open position to receive various articles. These references generally either disclose embodiments whereby a bag is first dispensed from a supply carton or station and then unfolded, opened and then tucked or taped into a clip type means or fed onto wickets through holes in the upper portion of the bags. Another embodiment (U.S. Pat. No. 810,329) discloses a bag holder having means for maintaining a bag in an open position while also having means for accommodating reverse bags. This reference, however, employs pressure type clip means for maintaining a bag in an open position and thus would require an operator to manipulate the top edge portion of a bag through several clip means before the bag is in an operative position to receive articles.

In addition to the awkwardness of positioning an opened bag on known retaining or supporting means, the removal of the bag after its desired contents are fed therein has proven to be just as cumbersome and time consuming.

An approach to eliminate the use of retaining or supporting means to maintain a bag in an open position is to increase the rigidity of the bag by using a material which has sufficient integrity to enable the bag to retain an upright open position without support means. This approach, however, would require a great increase in material cost thus making it an impractical commercial alternative.

Filed concurrently herewith by applicant and incorporated herein by reference in U.S. application Ser. No. 782,390 titled A BAG DISPENSER AND HOLDER disclosing a bag dispenser and support holder comprising a brace member having a pair of deformable, resilient, outwardly distending, spaced-apart support members, said support members comprising substantially straight inner segments for supporting a plurality of bags proximal the brace member through a pair of spaced-apart holes in the bags, and substantially curved, inwardly opposed outer segments which are aligned in a common plane to define a substantial hoop configuration; said brace member having at least one outwardly distending hook-wicket intermediate said distending pair of support members adapted for further supporting the plurality of bags through holes in said bags intermediate the pair of spaced-apart holes; and said outer segments of the support members and said at least one hook-wicket being adapted for supporting and maintaining a bag in an open position. As stated in the application, it is preferable to use at least two hook-wickets distending from the brace member so as to facilitate and insure the mouth of the bag being fully opened for optimum utilization.

It is an object of the present invention to provide a bag dispenser and support holder that will permit bags to be dispensed one at a time and sequentially held in an open position for receiving various size articles.

It is another object of the present invention to provide a bag dispenser and holder that is designed to facilitate the opening of a bag as it is fed from a supply station, then maintain the bag in an open position, and once the bag has received its desired contents, it is also designed to facilitate the closing of the bag.

Another object of this invention is to provide a bag dispenser and holder that is adapted to accommodate a plurality of reserve bags; adapted to facilitate the opening of a bag as it is fed from the reserve; adapted to maintain the opened bag in an upright position; and adapted to facilitate the closing of the bag once it is filled with a desired size and quantity of articles.

Another object of this invention is to provide a bag dispenser and holder that is easy to fabricate and easy to use.

Another object of the present invention is to provide a bag dispenser and holder that is designed to maintain a bag in an open position and adapted such that the bag can be closed after partial filling and then reopened to complete the filling of the bag thereby maintaining sanitary conditions during an interrupted filling operation.

The foregoing and additional objects will become more fully apparent from the following description and the accompanying drawing.

SUMMARY OF THE INVENTION

The invention relates to a bag dispenser and support holder comprising a brace member having a pair of outwardly distending spaced-apart, preferably substantially parallel, support members for supporting a plurality of flat or gusset bags through holes in said bags; a first deformable, resilient, substantially arcuate member depending from the end of one of said spaced-apart support members; a second deformable, resilient, substantially arcuate member depending from the end of the other of said spaced-apart support members; and said deformable, resilient, substantially arcuate members being outwardly and oppositely aligned in a common plane to define a substantial, open hoop configuration adapted to be intertwined with the mouth of the bag through bag wicket holes for supporting and maintaining the bag in an open position.

Preferably, the spaced-apart opposed ends of the deformable, resilient arcuate members should extend outwardly and be substantially parallel to the distending spaced-apart support members so as to facilitate the loading and removal of bags onto and off of, respectively, the bag dispenser and support holder.

As used herein, a deformable, resilient member shall mean a nonrigid or rigid member with or without cooperating spring means, respectively, that is capable of being deformed under pressure, return substantially to its original shape upon release of the pressure, and have sufficient resiliency to exert pressure on a surface opposing the return of the member to its substantially original shape.

As used herein, a substantially arcuate member shall mean a member having a bow or arc configuration made from one continuous curve, two or more curves, two or more straight segments arranged to provide an overall bow or arc configuration, or a combination of one or more curves and one or more straight segments arranged to provide an overall bow or arc configuration. The essential feature of the substantially arcuate member is that when it is oppositely aligned in a common plane with a second substantially arcuate member, it will define a substantial, open hoop configuration which can be utilized to maintain the mouth end of a bag in an open position.

The bag dispenser and holder can be made of a variety of materials, such as aluminum, steel, copper, plastics or various substrates coated with various types of coating materials which should be compatible with the material of the bags to be dispensed and have an elasticity sufficient to accomodate the bag dimensional design. The bag dispenser and holder could also be fabricated from a combination of the above materials or other type materials, or from rigid materials in conjunction with spring means as will be discussed below.

The bag should be made of a material having sufficient strength and the support wicket holes should be suitably disposed so that as a bag is pulled from the substantially straight segments onto the curved segments of the support members, the bag will apply a sufficient inward force on the curved segments to slightly collapse the curved segments so as to accommodate the spacing of the support wicket holes in the bag as the bag advances on the curved segments. Once the bag is fully advanced on the curved segments, the curved segments will exert an outwardly applied tensive force on the mouth of the bag sufficient to maintain the mouth of the bag in an open position. If desired, the bags for use on the dispenser and holder of this invention could be made with a cuffed mouth portion, that is, a two or more ply bag mouth portion, through which the wicket holes could be disposed. This will impart additional strength to the bag areas defining the wicket holes and thus enable the advancing bag to more effectively collapse the curved segments as discussed above.

BRIEF DESCRIPTION OF THE DRAWINGS

FIG. 1 is an isometric view of a gusset bag for use in the bag dispenser and holder of this invention.

FIG. 2 is an isometric view of an alternate embodiment of a gusset bag for use in the bag dispenser and holder of this invention.

FIG. 5 is a plan schematic view of bags assembled on a bag dispenser and holder in accordance with this invention showing the initial step in the dispensing of the first bag.

FIG. 6 is a plan schematic view of the bag dispenser and holder of FIG. 5 showing the advancement of the first bag into the initial open position.

In general, the present invention comprehends a bag dispenser and holder for a stack of flexible bags provided with paired holes to accommodate wicket support leg members and which bags are to be removed one at a time from the stack and held in an open position by substantially arcuate members depending from the wicket support members. The preferred bags for use in this invention are generally shown in FIGS. 1 and 2. Specifically, FIG. 1 shows a partially opened gusset bag 2 comprising a front ply 4, back ply 6 and side gussets 8 and 10. Disposed at the upper portion of the bag are paired wicket holes 12 and 14 which pass over and are supported on wicket support members 16 and 18, respectively, of bag dispenser and holder 20 shown in FIG. 3. Bag dispenser and holder 20 comprises a horizontal brace member 22 having depending therefrom wicket support members 16 and 18 which, in turn, terminate in deformable, resilient arcuate members 24 and 26, respectively. The extremities 28 and 30 of arcuate members 24 and 26 extend outward, preferably substantially parallel to the axis of the aligned holes 12 and 14 in bags 4, so as to facilitate the assembly of a stack of bags onto the bag dispenser and holder and also to facilitate the removal of the bags one at a time from the dispenser and holder.

FIG. 2 shows a partially opened gusset bag 32 which is similar to the bag 2 shown in FIG. 1 and having common designation numbers identifying similar parts of the bags. The only different between bag 2 in FIG. 1 and bag 32 in FIG. 2 is that a portion of the front ply 34 is lower than the back ply 6 to provide a lip 36 to facilitate opening of the bag 32. FIG. 4 shows a stack of bags 32 assembled on an identical bag dispenser and holder as shown in FIG. 3 and having identical parts identified with the same reference numbers.

FIGS. 5 through 11 schematically show the steps whereby a bag is first dispensed from a reserve bag supply on a bag dispenser and holder, then opened and retained in the opened position for receiving articles, followed by the final step of closing and simultaneously removing the filled bag from the bag dispenser and holder of this invention. Specifically, FIG. 5 schematically shows a stack of side gusset bags 36 assembled on a bag dispenser and holder 38 of the type shown in FIG. 3. The initial bag 40 from the bag stack 36 is advanced toward deformable arcuate members 42 and 44. As shown in FIGS. 5 to 11, the lateral distance between wicket holes 46 and 48 in bag stack 36 is designated X. Thus since the widest lateral distance between deformable arcuate members 42 and 44 is substantially larger than X, then said deformable members 42 and 44 are compressed by the advancing bag which collapses the hoop formed by said members 42 and 44. As shown in FIG. 6, the hoop (42-44) is collapsed by the advancing bag 40 a sufficient amount such that the lateral distance between the opposing arcuate members 42 and 44 is substantially about the distance X between the holes 46 and 48 of bag 36. The arcuate members 42 and 44 have to be deformable because the bag 40 has spaced apart holes 46 and 48 which are separated by a definite distance X. Thus in order for the bag to advance onto the arcuate members 42 and 44 via holes 46 and 48, it is essential that arcuate members 42 and 44 be deformed by the advancing bag 40 to accommodate the distance X between holes 46 and 48 of said bag 40. The area around the bag holes should be sufficiently strong so as to effectively collapse the arcuate member when advanced onto said arcuate members.

As shown in FIG. 7, deformable arcuate members 42 and 44 are held in the collapsed position by bag 40 as it is advanced and maneuvered along the length of said members 42 and 44. With bag 40 advanced sufficiently along members 42 and 44, said members 42 and 44 exert an outward tensive force on the bag 40 thereby maintaining the bag 40 in an open position as generally shown in FIG. 8. As shown in FIG. 9, the bag 40 is fully opened and is maintained in the open position by arcuate members 42 and 44 which form a substantial hoop configuration. The extremities 50 and 52 of deformable arcuate members 42 and 44 are shown crossed in FIG. 9 thereby indicating that the arcuate members 42 and 44 are exerting an outward tensive force which maintains bag 40 in the open position. As shown in FIG. 9, the arcuate members 42 and 44 are intertwined with bag 40 through wicket holes 46 and 48.

Figure 10:
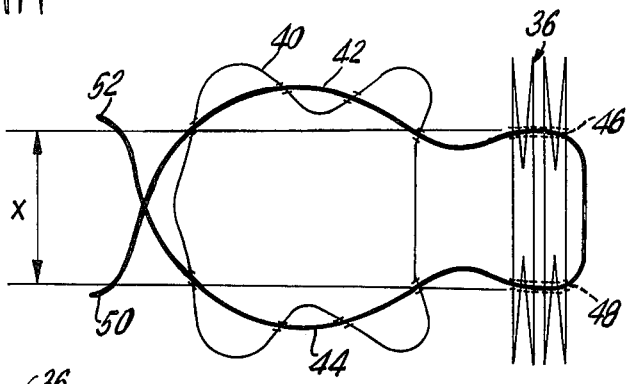
FIG. 10 is a plan schematic view of the bag dispenser and holder of FIG. 9 showing the initial dispensed bag being advanced for removal.
Figure 8:
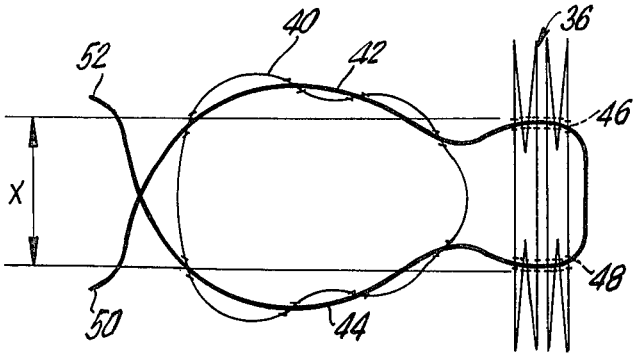
FIG. 8 is a plan schematic view of FIG. 7 showing the initial dispensed bag in a substantially open position.
Figure 11:
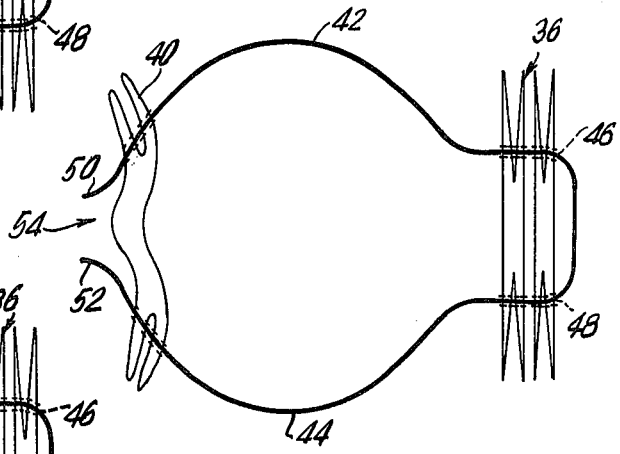
FIG. 11 is a plan schematic view of the bag dispenser and holder of FIG. 10 showing the bag in a closed position ready to be removed from the bag dispenser and holder.
Figure 9:
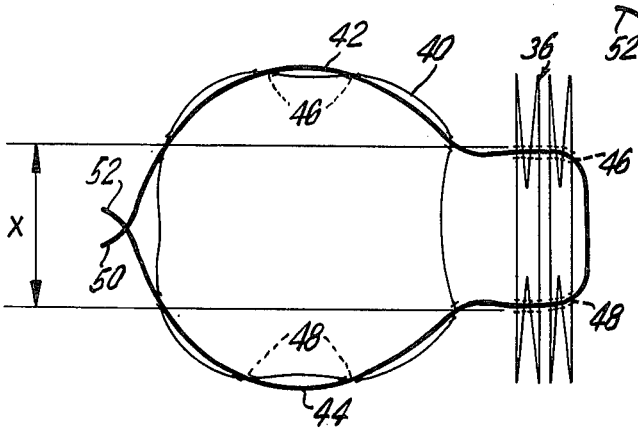
FIG. 9 is a plan schematic view of the bag dispenser and holder of FIG. 8 showing the bag in a fully opened position.

Once bag 40 is filled, arcuate members 42 and 44 are again collapsed as shown in FIG. 10 by bag 40 as it is further advanced and maneuvered along members 42 and 44 until it is gathered at the exit end 54 of the hoop formed by arcuate members 42 and 44 as shown in FIG. 11. As evident from FIGS. 10 and 11, as bag 40 is advancing toward exit end 54 of the hoop, it begins to close such that when it reaches the exit end 54, the bag is fully closed and ready to be sealed if desired. Although not shown, the extremities 50 and 52 of arcuate members 42 and 44 respectively, may be extended to form two closely spaced, substantially parallel legs onto which a filled bag could be advanced. The top edge portion of the bag so advanced on the legs would comprise opposed flat sides forming an envelope-type closure which could be appropriately sealed.

Figure 12:
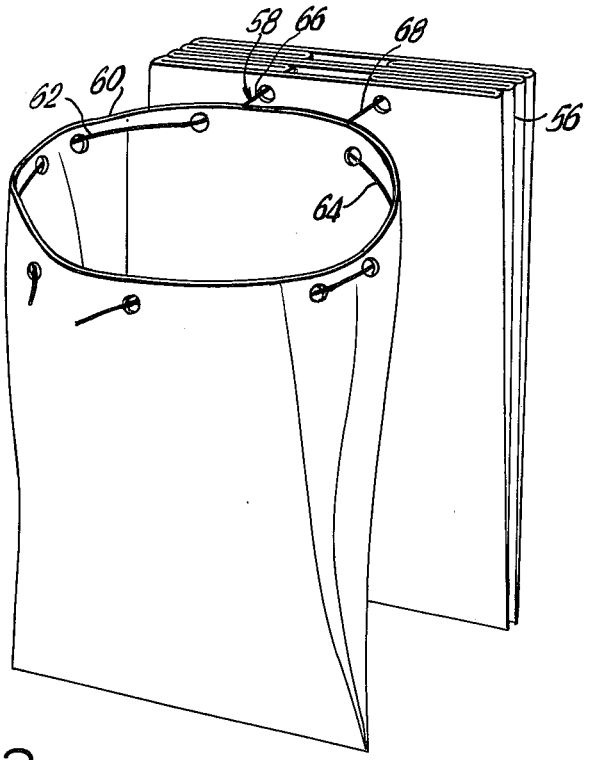
FIG. 12 is an isometric view of a fully opened bag on a bag dispenser and holder as shown in FIG. 3.
Figure 13:
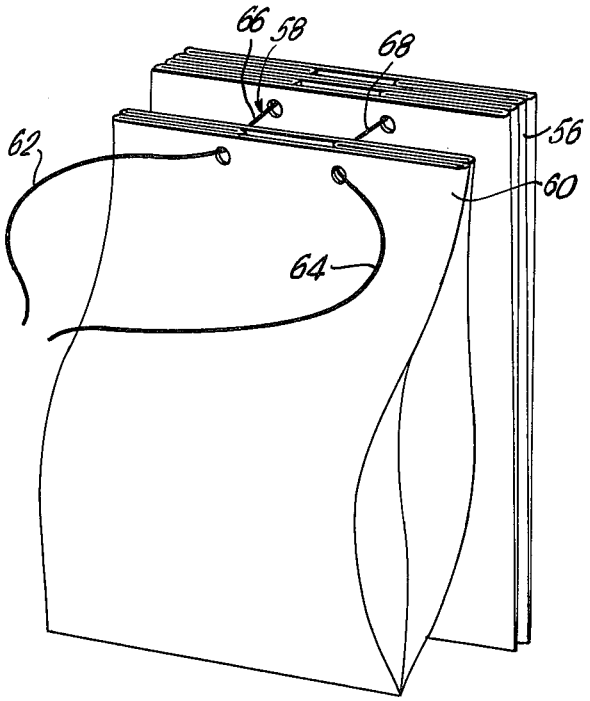
FIG. 13 is an isometric view of a closed, partially filled bag on a bag dispenser and holder of the embodiment shown in FIG. 12.

FIG. 12 shows an isometric view of a stack of bags 56 on a bag dispenser and holder 58 with a fully open bag 60 held and maintained in the open position by a hoop comprising arcuate members 62 and 64. After bag 60 is partially filled, it can be temporarily closed for sanitary purposes or the like by simply retracting bag 60 partially back onto support members 66 and 68 as shown in FIG. 13. The retracting of bag 60 can be accomplished by simply reversing the maneuvering procedure shown in FIGS. 5 through 9. Thereafter when bag 60 is to be completely filled, bag 60 is advanced to the fully opened position as shown in FIG. 12 using the procedure outlined in conjunction with FIGS. 5 through 9. Preferably, the overall perimeter of the open hoop formed by the arcuate members should be at least about 10 percent larger than the perimeter of the mouth of the bag to be dispensed and held open so as to assure a sufficient resilient bias by the hoop against the open mouth portion of the bag. This will insure that the bag will be retained in the fully open position for maximum utilization.

Figure 15:
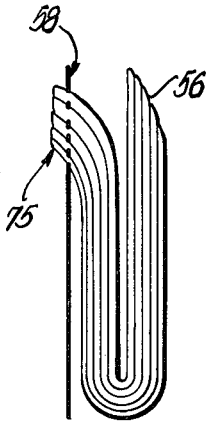
FIG. 15 is a side view of the bag dispenser and holder of FIGS. 3 and 4 showing a plurality of bags in the folded assembled position.
Figure 16:
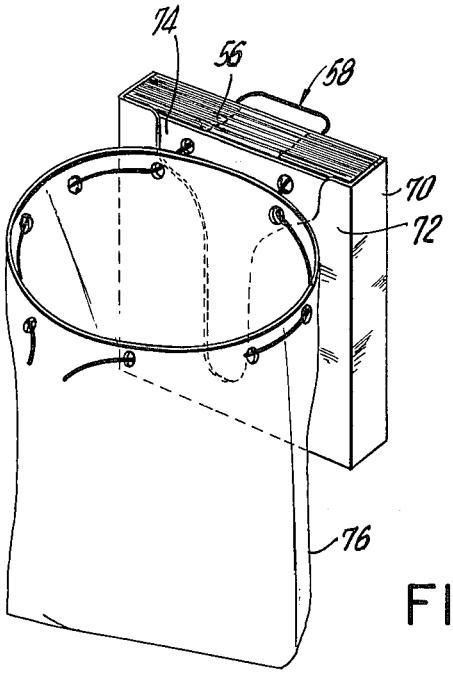
FIG. 16 is an isometric view of an open bag on a dispenser and holder in accordance with this invention.

A feature of the bag dispenser and holder 58 containing a stack of separate bags 56 as shown in FIG. 12 is that it can be assembled into a relatively small package as shown in FIG. 15. This will enable the dispenser and bags to be assembled into packages that are easy to handle and store thus making them ideal consumer products. The dispenser and holder 58 and bags 56 could also be packed into a carton 70 as shown in FIG. 16. Specifically, the bags 56 would be placed into carton 70 with the dispenser and holder 58 either within carton 70 or disposed parallel to the front wall 72 of the carton 70. In the latter arrangement, the top bag edges 75 (FIG. 15) would protrude out of the front wall 72 of carton 70 through a suitable opening 74. The complete assembly of bags, dispenser and carton could be wrapped with a suitable outer material, such as film or the like. When desired for use, after the outer film is removed the dispenser and holder 58 would be rotated normal to carton 70 and the first bag 76 would be pulled from carton 70 through opening 74. Thus, using the technique described in conjunction with FIGS. 5 through 9, the bag 76 would be advanced to the open position for utilization as shown in FIG. 16. Upon removal of bag 76, the dispenser and holder 58 could be rotated parallel to the front wall 72 of carton 70 and stored until again required.

Figure 14:
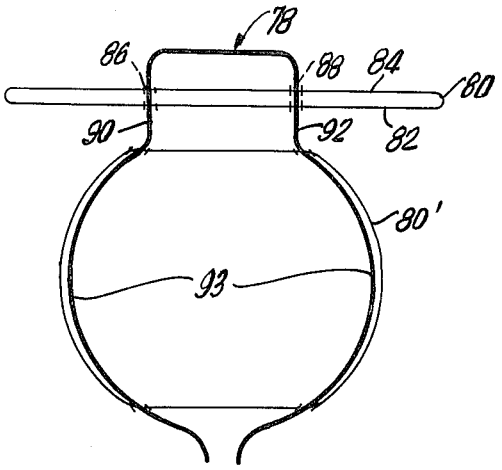
FIG. 14 is a plan schematic view of a bag dispenser and holder for use with flat-type bags.

The bag dispenser and holder 78 of this invention could be used with flat envelope-type bags 80 as shown schematically in FIG. 14. Specifically, bag 80 comprises a front ply 82 and rear ply 84, said plies 82 and 84 having a pair of wicket holes 86 and 88 adapted for assembling on support members 90 and 92, respectively, of bag dispenser and holder 78. Bag 80 can be advanced and maneuvered onto hoop 93 to its fully opened position 80′ as shown in FIG. 14 using the technique described in conjunction with FIGS. 5 through 9.

Figure 17:
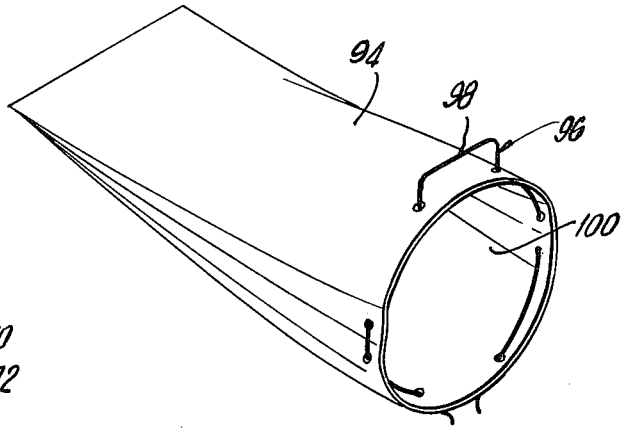
FIG. 17 is an isometric view of another embodiment of an open bag on a bag dispenser and holder in accordance with this invention.

One of the many uses of the bag dispenser and holder of this invention is for collecting leaves or the like. As shown in FIG. 17, a gusset-type bag 94 assembled in the fully opened position on a bag dispenser and holder 96 could be manually or otherwise held by the brace member 98 in a manner such that the opening 100 in the bag 94 would be normal to the ground or other support means thus facilitating the sweeping or pushing of leaves or other articles into the bag.

Figure 18:
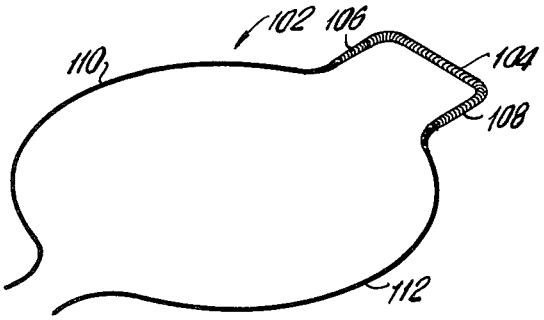
FIG. 18 is a schematic perspective view of a bag dispenser and holder employing a spring brace and spring supporting means in accordance with this invention.
Figure 19:
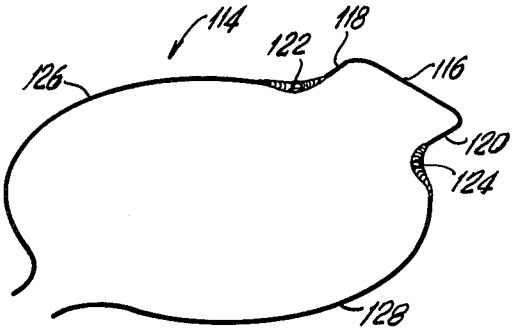
FIG. 19 is a schematic perspective view of a bag dispenser and holder employing rigid-type arcuate members depending from spring means connected to support members depending from a common brace member.

FIGS. 18 and 19 show alternate embodiments of the bag dispenser and holder of this invention. Specifically, in FIG. 18 the dispenser and holder 102 comprises a coil spring type horizontal brace member 104 having depending therefrom spring-type support members 106 and 108 which, in turn, terminate in resilient or nonresilient arcuate members 110 and 112. The coil spring-type brace member 104 and support members 106 and 108 will provide the arcuate members 110 and 112 with sufficient flexibility so as to facilitate the deforming of these members 110 and 112 to accommodate the advancement of a bag onto said members 110 and 112. In addition, the coil spring members will provide a resilient or mechanical biasing force on the arcuate members thus imparting to the arcuate members the necessary resiliency needed to maintain a bag in an open position.

In FIG. 19, a dispenser and holder 114 is shown which comprises a horizontal brace member 116 having depending therefrom wicket support members 118 and 120 which, in turn, are connected via coil spring members 122 and 124, respectively, to resilient or nonresilient arcuate members 126 and 128, respectively. Again, the coil spring members will facilitate the deforming of the arcuate members 126 and 128 to accommodate the advancement of a bag into said members 126 and 128.

Figure 20:
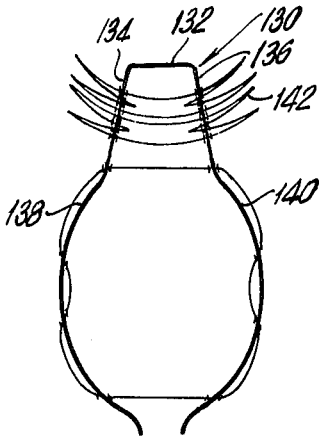
FIG. 20 is a plan schematic view of bags assembled on an alternate embodiment of a bag dispenser and holder in accordance with this invention.

As shown in FIG. 20, the bag dispenser and holder 130 could comprise a brace member 132 having depending therefrom outwardly tapered wicket support members 134 and 136 which, in turn, terminate in deformable, resilient arcuate members 138 and 140, respectively. As shown in FIG. 20, when bags 142 are assembled on support members 134 and 136 of this embodiment, they are slightly curved due to the outward tapered support members 134 and 136.

Figure 21:
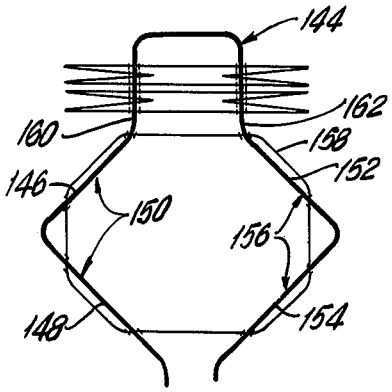
FIG. 21 is a plan schematic view of bags assembled on an alternate embodiment of a bag dispenser and holder in accordance with this invention.
Figure 22:
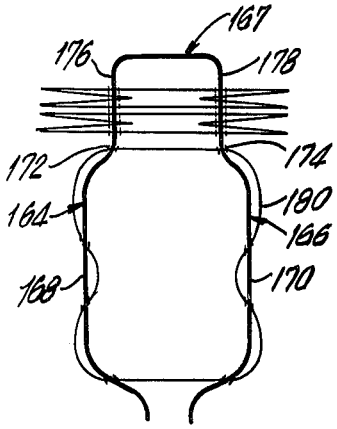
FIG. 22 is a plan schematic view of bags assembled on an alternate embodiment of a bag dispenser and holder in accordance with this invention.

FIG. 21 shows another embodiment of a bag dispenser and holder 144 which employs straight segments 146 and 148 to form a first substantially arcuate member 150 and straight segments 152 and 154 to form a second substantially arcuate member 156. Using the technique described in conjunction with FIGS. 5 through 9, a bag 158 can be advanced from wicket members 160 and 162 onto arcuate members 150 and 156 where it will assume the open position as shown in FIG. 21. In another embodiment as shown in FIG. 22, arcuate members 164 and 166 of bag dispenser 167 could comprise substantially straight segments 168 and 170 terminating at one of its ends in curved segments 172 and 174, respectively, coupled to wicket support members 176 and 178, respectively. Again, a bag 180 could be advanced from wicket members 176 and 178 onto arcuate members 164 and 166, respectively, where it will assume the open position as shown in FIG. 22.

Figure 23:
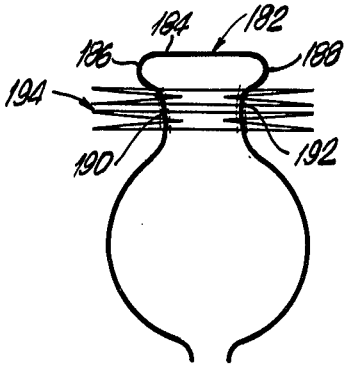
FIG. 23 is a plan schematic view of bags assembled on an alternate embodiment of a bag dispenser and holder in accordance with this invention.

FIG. 23 shows another embodiment of a bag dispenser and holder 182 wherein the ends of brace member 184 extend in opposing semi-circular segments 186 and 188 which, in turn, have depending therefrom wicket support members 190 and 192, respectively. This embodiment will prevent the bags 194 from sliding in contact with brace member 184 such that brace member 184 can be used as a handle for holding the bag dispenser 182. This embodiment of the bag dispenser would be useful in the arrangement shown in FIG. 17.

Figure 24:
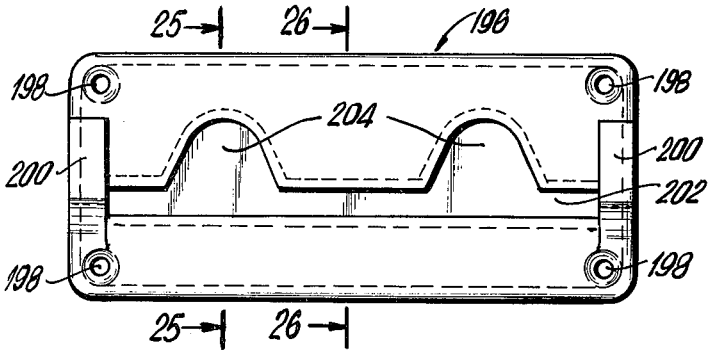
FIG. 24 is a front elevational view of a hinge and lock means for use with the bag dispenser and holder of this invention.
Figure 25:
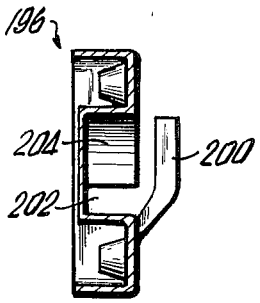
FIG. 25 is a cross sectional view taken along lines 25—25 of FIG. 24.
Figure 26:
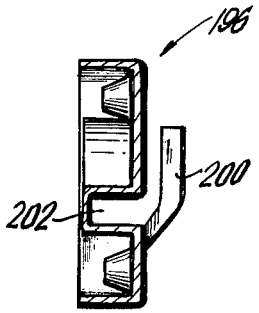
FIG. 26 is a cross sectional view taken along lines 26—26 of FIG. 24.
Figure 27:
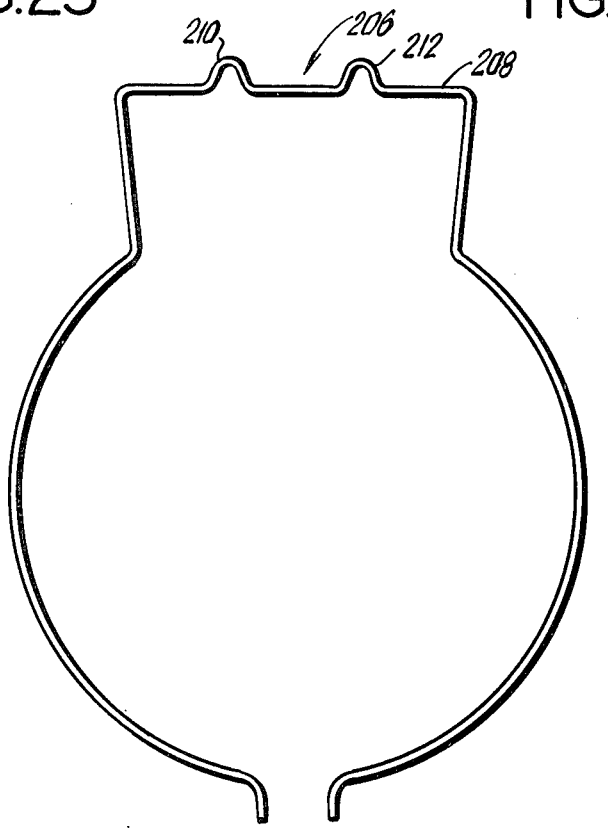
FIG. 27 is a plan view of a bag dispenser and holder for use with the hinge and lock means of FIG. 24.

To secure the bag dispenser and holder to a wall or other support, a hinge and lock member 196 as shown in FIG. 24 could be suitably attached to a surface via holes 198 using conventional screws (not shown). The hinge and lock member 196 has two spaced-apart U-shaped hooks 200 and a longitudinal groove 202. The groove 202 extends completely across hinge and lock member 196 as shown in FIG. 26 which is a view taken through line 26—26 of FIG. 24. Midway between the vertical center line and each edge of member 196, the groove would extend upward into a semi-circular configuration 204 as shown in FIG. 25 which is a view taken through line 25—25 of FIG. 24. FIG. 27 shows a bag dispenser and holder 206 having a brace member 208 designed with two rearwardly spaced apart semi-circular protrusions 210 and 212 adapted to fit within semi-circular grooves 204 in hinge and lock member 196. In operation, the bag dispenser would be vertically oriented and positioned on hooks 200 with protrusions 210 and 212 aligned with grooves 204. The bag dispenser 206 would be rotated to a horizontal position and shifted to either the left or right thereby securing the protrusions 210 and 212 within the narrow portion of groove 202 and thus securing the bag dispenser and holder 206 in a horizontal plane for use. The bag dispenser and holder 206 can be removed by simply aligning protrusions 210 and 212 with grooves 204 and then rotating it to a vertical position. The bag dispenser and holder 206 could then easily be removed from hooks 200.

Figure 28:
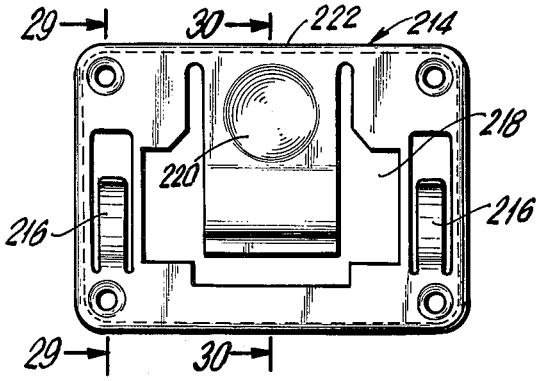
FIG. 28 is a front elevational view of a hinge and lock means for use with the bag dispenser and holder of this invention.
Figure 29:
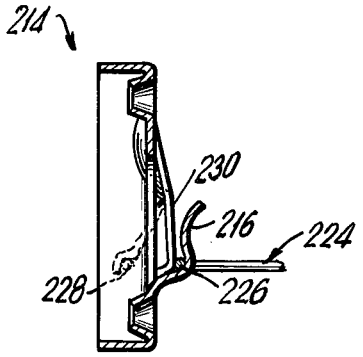
FIG. 29 is a cross sectional view taken along lines 29—29 of FIG. 28.
Figure 30:
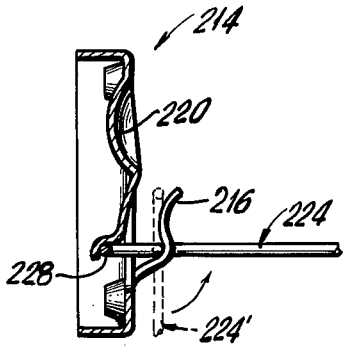
FIG. 30 is a cross sectional view taken along lines 30—30 of FIG. 28.
Figure 31:
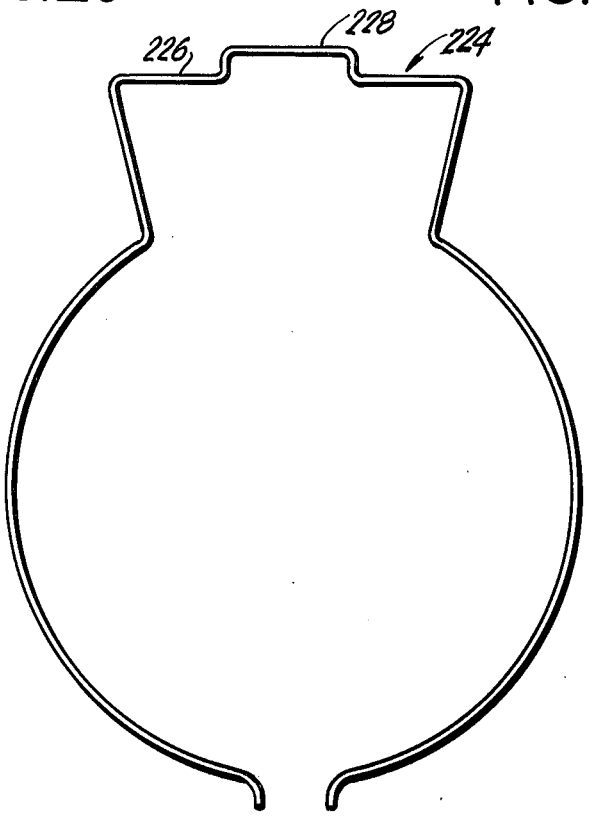
FIG. 31 is a plan view of a bag dispenser and holder for use with the hinge and lock means of FIG. 28.

FIG. 28 shows another embodiment of a hinge and lock member 214 having spaced-apart hooks 216. A center recess 218 is disposed in member 214 and a pivotal arm 220 attached to the upper wall 222 of member 214 is disposed over the recess 218. A bag dispenser and holder 224 for use with member 214 is shown in FIG. 31. Specifically, dispenser and holder 224 has a brace member 226 in which the center portion is extended rearwardly to form a rectangularly shaped protrusion 228. In operation, dispenser and holder 224 would be vertically held and placed onto hooks 216 whereupon it would be rotated to a horizontal position thereby being locked thereat by pivotal arm member 220 as shown in FIG. 30 which is a view taken through line 30—30 of FIG. 28 (including member 224) and held against wall 230 of member 214 as shown in FIG. 29 which is a view taken through line 29—29 of FIG. 28 (including member 224). To remove the dispenser and holder 224, member 220 is depressed thereby pivoting it inwardly thus allowing dispenser and holder 224 to rotate to the vertical position as shown by broken lines 224' in FIG. 30. Thereafter dispenser and holder 224 is removed from the hooks 216.

EXAMPLE

Figure 3:
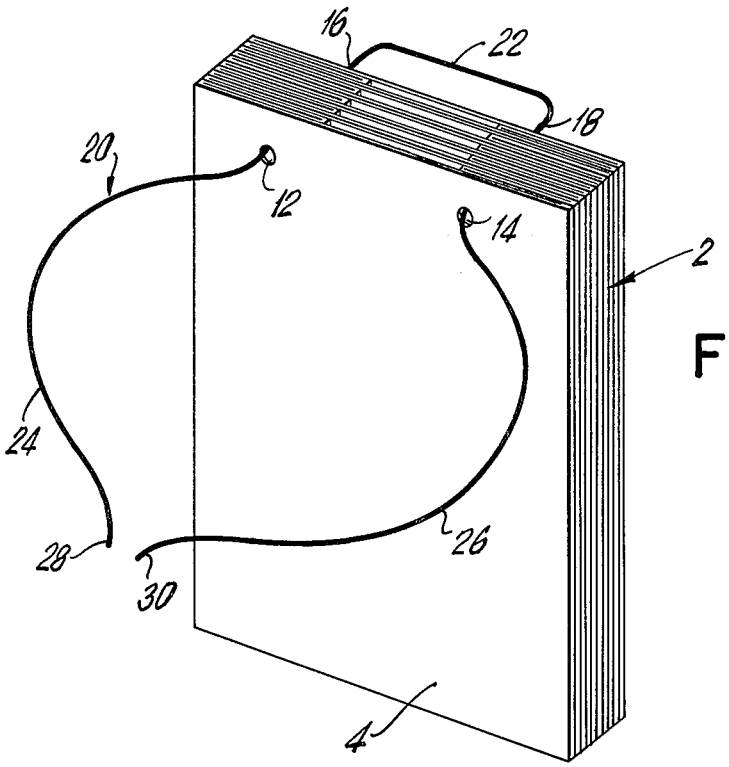
FIG. 3 is an isometric view of the bags of FIG. 1 assembled on a bag dispenser and holder in accordance with this invention.
Figure 4:
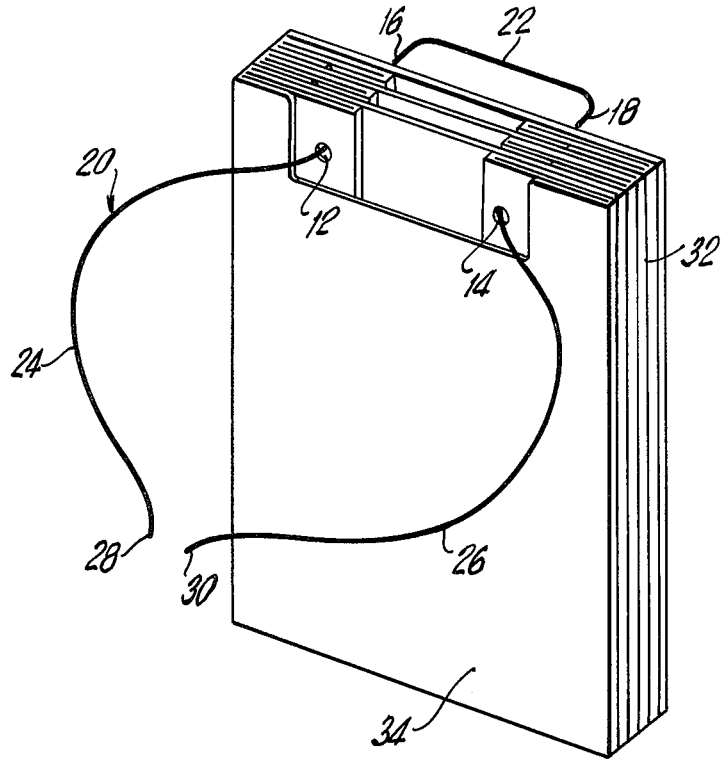
FIG. 4 is an isometric view of the bags of FIG. 2 assembled on a bag dispenser and holder of this invention.
Figure 7:
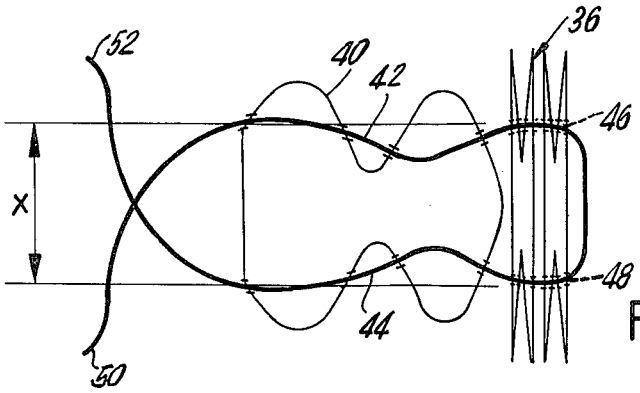
FIG. 7 is a plan schematic view of FIG. 6 showing the initial dispensed bag further advanced on the bag dispenser and holder of this invention.

A $\frac{1}{8}$ inch diameter steel wire was formed into a hoop as basically shown in FIG. 3. A plurality of $2\frac{1}{2}$ mil-thick polyethylene bags, having an opened bag mouth perimeter of 26 inches (66 cm), was folded in a gusset construction with approximately 30 percent of the bag perimeter constituting the front ply of the bag, 30 percent the back ply, and 20 percent for each gusset ply. The diameter of the hoop was about 9 inches (23 cm) and the wicket support members were spaced about $4\frac{1}{2}$ inches (12.5 cm) apart. At the top portion of each bag, a pair of wicket holes spaced $4\frac{1}{2}$ inches (12.5 cm) apart was punched through the front, back and gusset plies of the bag. The bags were assembled onto the wicket support members and then using the techniques described in conjunction with FIGS. 5 to 11, the first and then succeeding bags were dispensed from the wicket members, retained in a fully opened position as shown in FIG. 12, and then removed from the dispenser. The bag dispenser and holder worked easily and no problems were encountered.

It should be understood that the foregoing disclosure relates to preferred embodiments of the invention and it is intended to cover all changes and modifications of the invention which do not depart from the spirit and scope of the appended claims.

For example, a small portion of the back ply of the outermost disposed bag of a stack of bags could be adhesively secured to a corresponding small portion of the front ply of the succeeding underlying bag which, in turn, could be adhesively secured in a like manner to the next succeeding bag and so on in sequence. Thus when the outermost bag is being removed from the dispenser and holder, the back ply of the bag will automatically advance the front ply of the next succeeding bag along the curved segments thereby opening said succeeding bag. The initial bag upon being removed from the dispenser and holder could be easily separated from the succeeding bag. Another feature of using a stack of adhesively secured bags is that when a bag is advanced to the open position, its back ply will be secured to the front ply of the succeeding bag thereby enabling the bag to be in a more fully open position for utilization.

What is claimed is:

1. A bag dispenser and support holder comprising a brace member having a pair of outwardly extending, spaced-apart support members adapted for supporting a plurality of bags having holes in the mouth of said bags; a first deformable, resilient, substantially arcuate member extending from the end of one of said spaced-apart support members; a second deformable, resilient, substantially arcuate member extending from the end of the other of said spaced-apart support members; and said deformable, resilient substantially arcuate members being outwardly and oppositely aligned in a common plane to define a substantial, open hoop configuration, said arcuate members being operable such that as a bag is advanced from the support members, the bag will apply a sufficient inward force on the arcuate members to slightly collapse the arcuate members such that their extremities overlap so as to accommodate the spacing of the support wicket holes in the bag and once the bag is fully advanced on the arcuate members, the arcuate members will exert an outwardly applied tensive force on the mouth of the bag sufficient to maintain the mouth of the bag in an open position.

2. The bag dispenser and support holder of claim 1 wherein said spaced-apart support members are substantially parallel.

3. The bag dispenser and support holder of claim 2 wherein the opposed ends of the deformable, resilient, substantially arcuate members extend outwardly and are substantially parallel to the spaced-apart support members so as to facilitate the loading and removal of bags onto and off of, respectively, the bag dispenser and support holder.

4. The bag dispenser and support holder of claim 1 wherein the brace member is a spring member which imparts resiliency to the arcuate members.

5. The bag dispenser and support holder of claim 1 wherein the spaced-apart support members are spring members which impart resiliency to the arcuate members.

6. The bag dispenser and support holder of claim 1 wherein the spaced-apart support members are outwardly tapered members.

7. The bag dispenser and support holder of claim 1 wherein the ends of the brace member terminate in outwardly and oppositely opposed curved members from which the spaced-apart support members distend; and wherein the lateral distance between the curved members is different than the lateral distance between the spaced-apart support members so as to prevent bags on said spaced-apart support members from contacting the brace member thereby resulting in the brace member being adaptable as a handle for the bag dispenser and support holder.

8. The bag dispenser and support holder of claim 1 wherein a plurality of bags, each having a pair of wicket holes in its mouth portion, is supported on the support members through said holes.

9. The bag dispenser and support holder of claim 8 wherein the substantially arcuate members will exert an outward tensive force on the mouth portion of a bag held and supported on said arcuate members.

10. The bag dispenser and support holder of claim 8 wherein said bags are flat bags.

11. The bag dispenser and support holder of claim 8 wherein said bags are gusset bags having a front ply, back ply and side gussets.

12. The bag dispenser and support holder of claim 11 wherein the wicket holes in the bags are through the front ply, back ply and side gussets of the bags.

13. The bag dispenser and holder of claim 8 wherein said bag dispenser and holder is disposed substantially parallel with said bags; and said bags and bag dispenser and holder are disposed in a carton of suitable size to substantially envelop said bags and said bag dispenser and holder.

14. The bag dispenser and holder of claim 8 wherein said bag dispenser and holder is disposed substantially parallel with the bags; said bags are disposed in a carton of suitable size to substantially envelop said bags; and said bag dispenser and holder is disposed outside of and substantially parallel to the surface of said carton.

15. The bag dispenser and holder of claim 1 wherein the brace member comprises a substantially horizontal segment which has at least one rearward protrusion extending therefrom; a securing plate adapted for being secured to a support member and having spaced-apart hooks and a groove therein; said rearward protrusion being adapted for seating and locking within the groove in said securing plate and said horizontal segment being adapted for seating and resting within the hooks on said securing plate.

* * * * *